US005740711A

United States Patent [19]

Ramirez

[11] Patent Number: 5,740,711

[45] Date of Patent: Apr. 21, 1998

[54] WORK PIECE GUIDE FOR SAW

[76] Inventor: Rudy R. Ramirez, 3756 E. 22nd St., Tucson, Ariz. 85713

[21] Appl. No.: 579,862

[22] Filed: Dec. 26, 1995

Related U.S. Application Data

[63] Continuation-in-part of Ser. No. 33,857, Jan. 23, 1995.

[51] Int. Cl.[6] ..... B26D 7/06

[52] U.S. Cl. ..... 83/438; 83/477.2; 83/451; 269/21

[58] Field of Search ..... 83/98, 168, 100, 83/438, 477.2, 451, 402; 269/21, 303, 304, 315

[56] References Cited

U.S. PATENT DOCUMENTS

| | | | |
|---|---|---|---|
| 2,117,797 | 5/1938 | Flynn et al. | 83/100 X |
| 2,925,017 | 2/1960 | Bales et al. | 269/21 X |
| 3,750,507 | 8/1973 | Gerber et al. | 83/451 X |
| 3,815,221 | 6/1974 | Pearl | 269/21 X |
| 4,144,781 | 3/1979 | Kreitz | 83/101 X |
| 4,485,711 | 12/1984 | Schnell | 83/438 X |
| 4,635,515 | 1/1987 | Altman | 83/438 X |
| 4,638,695 | 1/1987 | Striebig | 83/100 X |
| 4,693,458 | 9/1987 | Lewecke et al. | 269/21 X |
| 4,694,719 | 9/1987 | Levene et al. | 83/451 X |
| 4,696,213 | 9/1987 | Conneally | 83/438 X |
| 4,742,743 | 5/1988 | Scarpone | 83/104 X |
| 5,144,873 | 9/1992 | Nasu | 83/451 X |
| 5,158,001 | 10/1992 | Udelhofen et al. | 83/100 X |
| 5,211,092 | 5/1993 | Blasi | 83/98 X |
| 5,379,815 | 1/1995 | Brazell et al. | 83/451 X |
| 5,465,951 | 11/1995 | Burt et al. | 269/21 X |

*Primary Examiner*—Rinaldi I. Rada
*Assistant Examiner*—Boyer Ashley
*Attorney, Agent, or Firm*—Gregory J. Nelson

[57] ABSTRACT

A work piece guide and retention device for use with a power saw or similar power tool. The guide attaches to the power saw table and has one or more vacuum chambers having orifices. When a vacuum from a source such as a shop vacuum is applied to the chamber, a suction force is generated at the orifices which will serve to secure a work piece snugly against the guide to assist the operator.

6 Claims, 2 Drawing Sheets

12
62
72
110A
100A
102A
50
102
58
70
60
56
54
110
52
30
44
38
75
32
26
20
15
18
16
40
34
22
10
19

WORK PIECE GUIDE FOR SAW

CROSS REFERENCE TO RELATED APPLICATION

This application is a continuation-in-part of copending application Ser. No. 29/033,857 filed on Jan. 23, 1995.

BACKGROUND OF THE INVENTION

Field of the Invention

The present invention relates to an accessory for a power cutting or shaping tool such as a table saw or a bench saw and more particularly relates to a guide which assists in securing a work piece in position while the work piece is guided through and past the saw blade.

Power tools are widely used by wood workers and bench and table saws provide the wood worker the advantage of being able to rip and cut wood with facility. In the ripping operation, wood is generally guided along a saw fence which is adjustably positioned on the table top. In ripping a longer piece of wood, such as a length of 1"×6" board, the wood worker will feed the work piece through the saw blade area while holding the work piece in contact with the fence using either direct manual pressure or pressure applied by a pusher stick or rod. However, it is not uncommon for the work piece to stray from the surface of the fence losing contact and resulting in inaccuracies in the cutting operation.

Various accessory devices for saws and cutting apparatus can be found in the prior art. However, none are known to the present inventor which utilize a vacuum to hold material in position to achieve both safe operation and precision in the cutting operation. The following patents are believed representative of the prior an in the field of cutting devices and accessories which utilize a vacuum to enhance the cutting operation.

For example, U.S. Pat. No. 3,978,749 shows a cutting device for plates such as circuit boards. The device has a knife and suction funnel arranged above the knife which is displaced with the knife and draws off vapors produced by hot cutting of the laminate. A suction funnel opens into a flexible suction tube connected to an exhaust pipe which leads to an exhaust vent.

Several prior art patents show dust collecting and confining devices for use with table saws. U.S. Pat. No. 4,255,955 shows a dust tight housing for confining, collecting and removing saw dust generated by a power saw. The device surrounds the blade in a dust-tight relationship and the lower end of the housing is connected by a conduit to a suction source.

U.S. Pat. No. 4,875,398 shows a retractable dust control hood for a rotary saw. The hood is supported by a linkage and a counter-balancing mechanism. The support is connected to the vacuum pump for evacuating dust from the hood through the flexible conduit.

The only prior art patent presently known to the inventor which utilizes a vacuum to secure a work piece in place is U.S. Pat. No. 4,494,433. This patent shows an apparatus for working on sheet material and has a fluid permeable support device upon which the sheet material is located. The device has a vacuum source which produces a vacuum which operates to hold the sheet material on the surface. The vacuum box is supported for longitudinal movement with the blade relative to the support surface. The vacuum is applied in the region where the blade operates.

From the foregoing, it is apparent that vacuum devices for assisting in cutting operations are known to some extent but are generally devices for specialized applications. Accordingly, there exists a need for a simple and effective device which may be used both by the hobbyist and professional wood worker which device may be attached to the existing fence of a table saw to secure a work piece snugly in place to provide safety, improved accuracy and precision in the cutting operation.

SUMMARY OF THE INVENTION

The present invention provides a guide and retention device which operates to maintain a work piece in proper position during a cutting or shaping operation. The device of the invention is intended primarily for use in connection with bench or table type saws having a planar surface which supports a fence which is selectively positionable with respect to the saw blade. The guide device has an elongate body which extends substantially the width of the surface of the saw table and is attachable to the existing fence. A planar guide surface is disposed parallel to the surface of the fence. The body of the guide has one or more internal chambers or cavities which are connectable to a vacuum source, such as a shop vacuum, by means of a conventional flexible vacuum hose. A plurality of longitudinally aligned orifices extend through the planar guide surface communicating with the internal cavity in the housing. In use, the orifices are positioned generally in the area or zone extending from the saw blade rearwardly and are oriented toward the work piece. When vacuum is applied to the chamber, a suction force is generated which will assist in securing the work piece snugly against the guide so that the work piece does not stray from the guide during the sawing operation. The vacuum does not generate sufficient force to interfere with the cutting operation and smooth feeding of the material.

The guide frees the operator as the work piece does not have to be continuously held in place by the operator. The operator may rely upon the holding force generated by the vacuum chamber to secure the material so that more precise cutting tolerances are achieved. Improved safety is also achieved in that the material does not have to be continuously held or manipulated by the operator exposing the operator to increased chance of injury. Instead, the material is held in place by the device once adequate suction is achieved.

In the preferred embodiment, the housing is provided with multiple vacuum chambers having orifices located to accommodate both smaller and larger work pieces.

Accordingly, it is the broad object of the present invention to provide a guide which is selectively attachable to the existing fence of a table or bench saw in order to provide a vacuum-induced retention force which will secure material snugly against the apparatus to allow the user to safely advance the material through the cutting area and also achieve improved cutting accuracy.

BRIEF DESCRIPTION OF THE DRAWINGS

The above and other objects and advantages of the present invention will be more fully understood and appreciated from the following description, claims and drawings in which:

DETAILED DESCRIPTION OF THE INVENTION

Figures 1, 2, 3, 4:
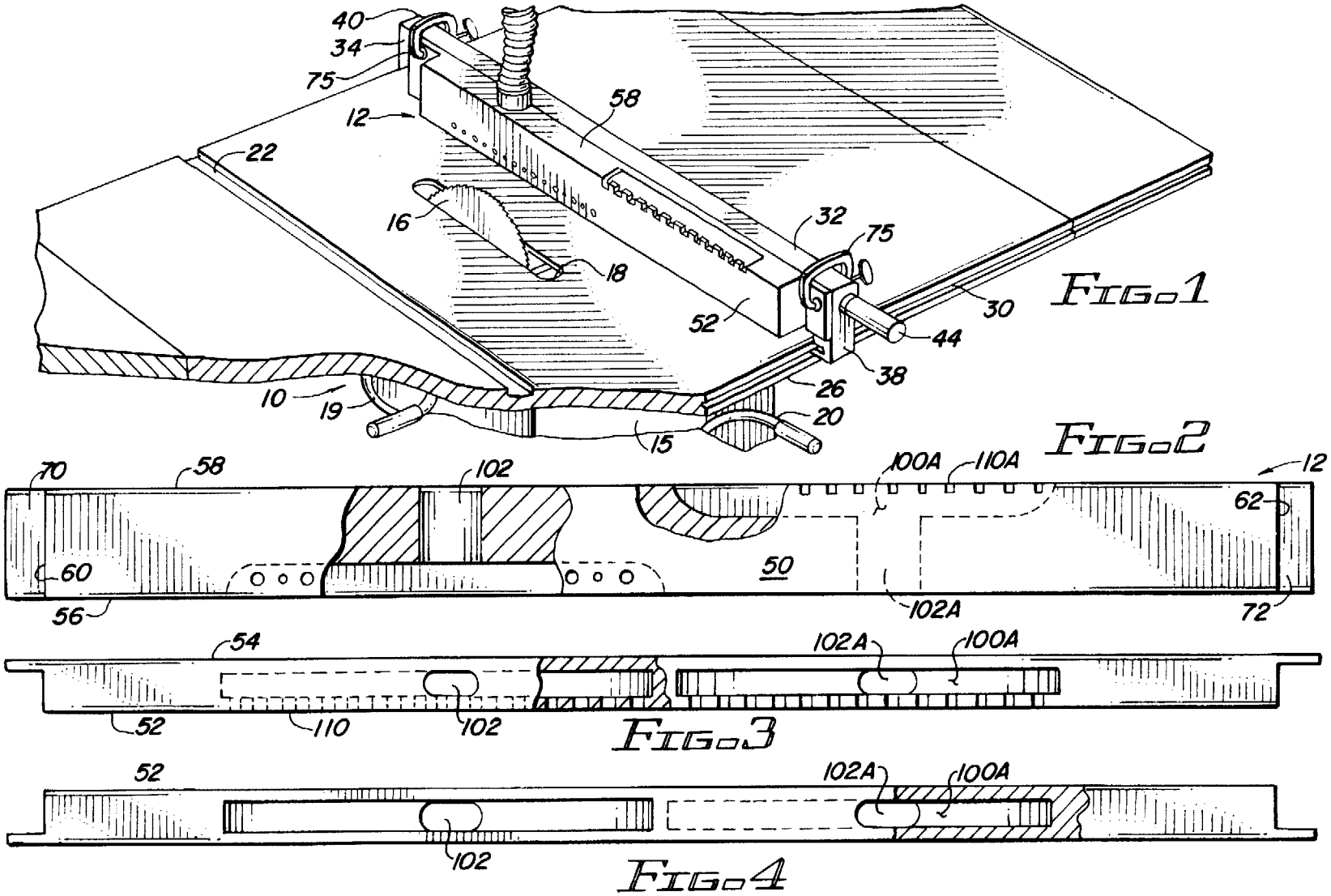
FIG. 1 is a perspective view of a table saw showing the guide of the present invention attached to the fence of the saw.
FIG. 2 is a side elevational view of the guide shown in FIG. 1 partly broken away for purposes of illustration.
FIG. 3 is a top view of the guide partly broken away for purposes of illustration.
FIG. 4 is bottom view of the guide of the present invention.

Turning to the drawings, particularly FIG. 1, a conventional table or bench saw is designated by the numeral 10. The bench saw 10 is representative of the type of power tool with which the guide 12 of the present invention may be used. While the present invention will be described with respect to use with a table saw, it will be appreciated that the invention may be used with other types of power devices such as routers and other shaping and cutting devices for wood and other types of materials.

The table saw 10 has a generally planar table surface 14 which is supported on a housing or base 15 which contains a motor, not shown, which powers saw blade 16. Saw blade 16 extends through an aperture 18 in the surface of the table. The height of the blade can be adjusted at hand wheel 19 and similarly the angle of the blade with respect to the table surface 14 may be adjusted at hand wheel 20 as is conventional.

The surface of the table defines one or more miter gauge slots 22 which extend from the front edge 26 of the table surface 14 to the rear edge 28 of the table. The front and rear edges of the table are also provided with fence guides 30 which may be in the form of a rail or a groove which support the fence 32 and allow it to be transversely adjusted. The fence 32 is generally elongate and extends from the front of the table to the rear of the table on the guides and has a front planar surface 34 against which a work piece is normally positioned when ripping a work piece. The fence is transversely slidable in the guides 30 at rip fence adjustment brackets 38 and 40. It is common for dimensional indicia to be etched or engraved on the table surface or on the guide and the fence can be locked at a predetermined position by locking handle 44. A pivotally mounted blade guard is normally provided as a safety feature but has not been shown for purposes of illustration and clarity.

The guide 12 of the present invention is seen in FIGS. 2 through 6 and 7 and 8. The guide consists of a body 50 which is generally elongate having a generally planar front wall 52, a planar parallel rear wall 54 and planar opposite sides 56 and 58. Ends 60 and 62 complete the structure of the body. The body is generally rectangular in cross section and is dimensionally similar to a conventional fence such as fence 32 normally associated with a table saw. The overall length of the body 50 is preferably slightly less than the overall depth of the table saw surface 14. Mounting means in the form of a pair of flanges 70 and 72 extend from the opposite ends 60 and 62, respectively, of the housing. As seen, the flanges 70 and 72 provide locations for detachably securing the housing to the fence 32 by conventional means such as "C" clamps 75 as seen in FIG. 1, although it will be appreciated that other conventional mounting devices such as bolts, interlocking flanges, clips and the like may be used to detachably secure the guide to the fence. The guide may also have brackets similar to brackets 38 and 40 to permit it to be secured to the fence guide 30.

Figure 7:
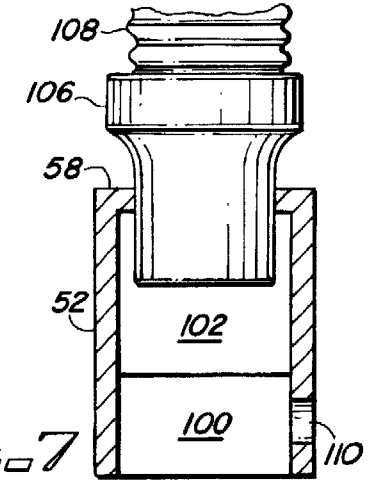
FIG. 7 is a sectional view taken along line 7—7 of FIG. 5.

The body 50 defines one or more vacuum chambers. A first a vacuum chamber 100 is formed within the body 50 opening to the side 56. Vacuum chamber 100 extends a distance spaced inwardly from end 60 to the approximate mid-point of the body 50. A generally cylindrical port 102 extends from the chamber 100 to the side 58 of the body. The port 102 has a diameter selected to correspond to the diameter of the fitting 106 on the end of the conventional vacuum hose on devices such as those sold under the trademark SHOPVAC. FIG. 7 illustrates the connection of the guide to a vacuum source.

A plurality of orifices 110 extend through the wall 52 communicating with the vacuum chamber 100. The orifices 100 are preferably approximately ½" diameter with 31/64" diameter found to be effective and are spaced on an axial center line parallel to side 56 of the guide and located about ¾" above the plane of side 56. As will be explained hereafter, the vacuum chamber 100 and orifices 110 are normally positioned at a location on the table extending from the area saw blade rearwardly when working with a stock above approximately ¾" in thickness.

Figure 8:
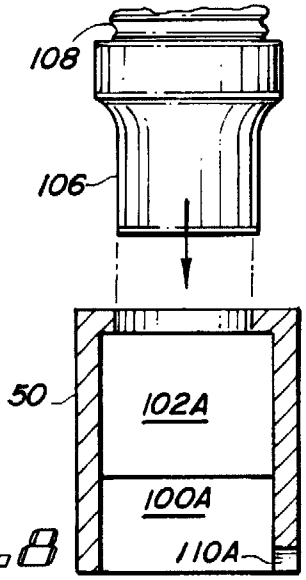
FIG. 8 is a sectional view taken along line 8—8 of FIG. 6.

When working with stock having a width less than ¾" or so, orifices 110A are normally positioned in the working area which is the area from the cutting area rearward of the blade. Orifices 110A are smaller and may be circular but are shown as being generally rectangular in cross section and are in the form of notches intersecting the lower edge 58. The notches 110A are about ⅜" on each side and 13/32" has been found to work well. Port 102A communicates with chamber 100A and extends from side 56 into the chamber and is sized for convenient insertion and connection of a vacuum hose 108 and fitting 106 as seen in FIG. 8. The body may be milled from a metal block such as aluminum or may be fabricated as by injection molding from a suitable durable plastic such as ABS.

Figure 9:
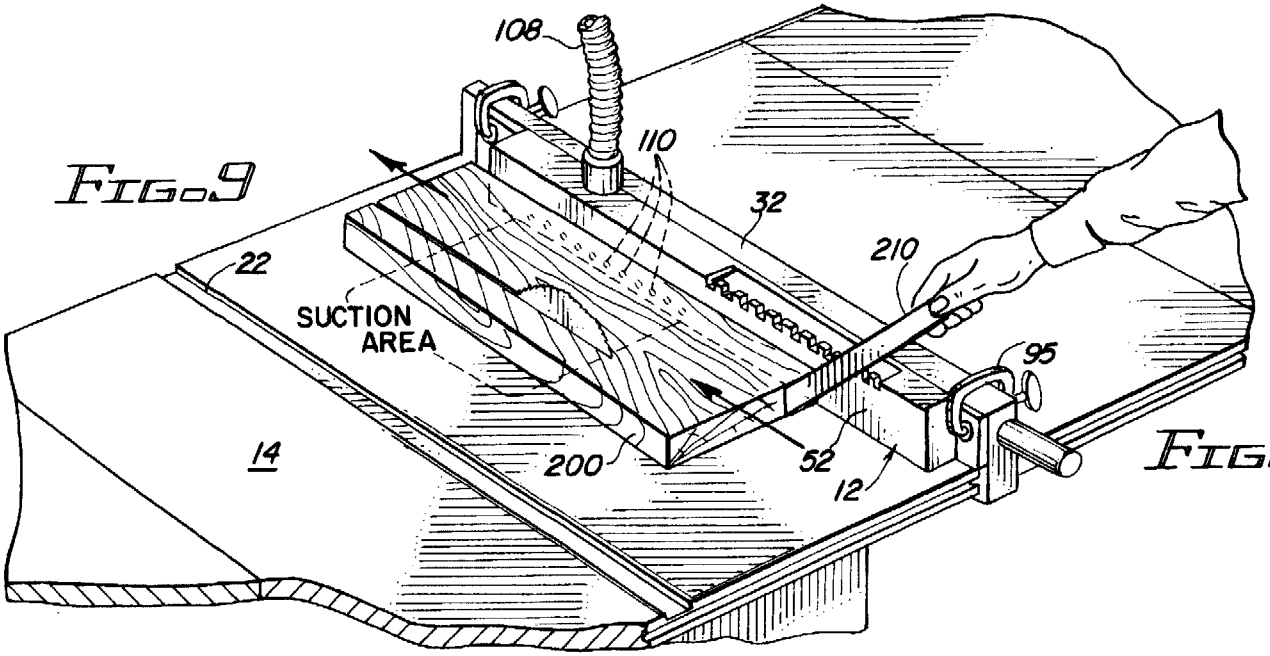
FIG. 9 is a perspective view showing the guide in use with a work piece being fed through the saw.
Figure 5:
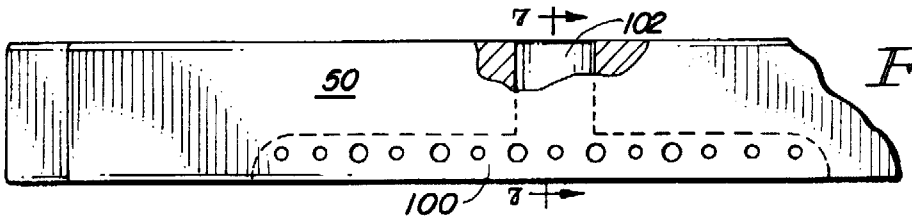
FIG. 5 is an enlarged elevational view of a portion of the left end of the guide as seen in FIG. 1.
Figure 6:
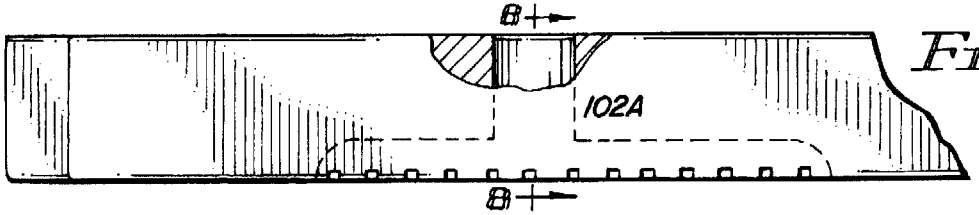
FIG. 6 is enlarged elevational view of a portion of the guide of the present invention which has been inverted and reversed from the position shown in FIG. 5.

The present invention will become better understood from the following description of use. The guide 12 is installed by attaching it to a conventional table saw 10 by fasteners such as clamps 75 as shown in FIG. 9. The guide is attached to the fence 32 on the side of the fence adjacent the saw blade 16. The guide is positioned with either the larger orifices 110 or the smaller orifices 110A disposed near the table surface in the working area adjacent and extending rearward of the saw blade. With thicker working stock, such as stock ¾" thick or more, the larger orifices 110 would be positioned in this working area. If thinner stock is being worked, the guide is reversed and the smaller orifices 110A are positioned in this work area. In FIGS. 1 and 9, the larger orifices 110 are shown positioned in the working area.

The guide is actuated by inserting the end 106 of the vacuum hose 108 into the appropriate port such as port 102 as seen in FIG. 7. Once the vacuum source is attached, the vacuum source is actuated and a vacuum is imposed in the vacuum chamber and a suction force is generated at the aligned orifices 110.

The operator will then power the saw and feed the stock 200 through the working area in engagement with the vertical surface 52 of the, guide.

As the work piece engages the saw blade it is initially cut and as it is further advanced, it is brought into contact with the effective suction area defined by the longitudinally extending orifices 110, as indicated in FIG. 9. In this area, a suction force will engage the work piece and snugly retain the work piece against the guide so that an accurate cut results. The material 200 does not have to be continuously held in place by the operator as the operator may rely on the retention force exerted by the vacuum chamber to true material to acceptable tolerances. The operator remains free to leave the work piece material 200 in any position during the cutting operation. The device provides increased safety of use in that the work piece material does not have to be continuously manipulated by the operator but is held in place by the suction. The suction force is not so great so as not to impede the cutting operation. The operator may chose to feed the material through the cutting area manually or using a push rod 210 as shown in FIG. 9.

Truing material is easily accomplished as one side of the work piece 200 is first cut and then the work piece is reversed and fed through the cutting area using the guiding apparatus. The resulting work piece will be trued with both sides being precisely parallel.

The device also works well when cutting extremely thin pieces. If thin pieces are to be cut, a zero tolerance insert is placed about the saw blade so the thin pieces will not fall into the area between the saw blade and the table. With the insert in place, the guiding apparatus is positioned with the smaller orifices 110A positioned in the working area and oriented toward the saw blade. The fence may then be moved to bring the planar surface 52 of the guide in close proximity to the saw blade 16, for example, spaced ⅛" from the saw blade. The material can be fed through the working area with the push rod 210 as shown in FIG. 9 and extremely thin and accurately cut strips such as ⅛" square pieces can be fabricated in this manner.

From the foregoing, it will be seen that the present invention provides a simple and effective guiding device for guiding and securing a work piece material so that additional safety and small tolerances are available with a conventional bench or table saw.

It will be obvious to those skilled in the art to make various changes, alterations and modifications to the invention described herein. To the extent these various alterations, changes and modifications do not depart from the spirit and scope of the appended claims, they are intended to be encompassed therein.

I claim:

1. A work piece guide for attachment to a power saw workbench having a generally planar work surface with a cutting blade extending therethrough and of a type comprising: a rip fence adjustably positionable on said work surface in parallel relationship with respect to said blade, wherein the work piece guide includes:

(a) a generally elongated body having a generally rectangular cross section with first and second generally parallel opposite sides and first and second opposite edges;

(b) said body defining first and second spaced-apart vacuum chambers therein;

(c) said body defining a first plurality of aligned orifices located adjacent said first edge and one of said sides of said body and communicating with said first chamber;

(d) said body defining a second plurality of aligned orifices located adjacent said second edge and the other of said sides, said second plurality of orifices being of a smaller size than said first plurality of orifices and communicating with said second chamber;

(e) mounting means for detachably securing said body and said work surface rip fence in a first position with the first plurality of orifices disposed facing the saw blade and being generally perpendicular to the table surface and said body being positionable in a second position with said second plurality of orifices disposed facing the saw blade; and (f) first and second ports communicating respectively with said first and second chamber for selective connection to a vacuum source whereby a retention force will be imparted holding the work piece in place against one of said sides of said body.

2. The guide of claim 1 wherein said body is metal.

3. The guide of claim 1 wherein said body is plastic.

4. The guide of claim 1 wherein said ports are sized to receive the fitting of the vacuum hose of a conventional shop-type vacuum.

5. The guide of claim 1 wherein said second plurality of orifices are disposed adjacent a side and an edge.

6. The guide of claim 1 wherein said attachment means comprises a pair of flanges attached to said body and securable to said fence.

* * * * *